US005749101A

United States Patent [19]

Breindel

[11] Patent Number: 5,749,101

[45] Date of Patent: May 12, 1998

[54] MEN'S PADDED BRIEF

[76] Inventor: Harold Breindel, 75 Albertson Ave., Albertson, N.Y. 11507

[21] Appl. No.: 766,937

[22] Filed: Dec. 16, 1996

Related U.S. Application Data

[63] Continuation of Ser. No. 493,921, Jun. 23, 1995, abandoned.

[51] Int. Cl.[6] ..... A41B 9/02

[52] U.S. Cl. ..... 2/403; 2/400; 2/98; 2/99

[58] Field of Search ..... 2/400, 403, 406, 2/267, 227, 228, 238, 455, 456, 114, 2; 450/97, 99

[56] References Cited

U.S. PATENT DOCUMENTS

| | | | |
|---|---|---|---|
| 2,332,141 | 10/1943 | Greene | 450/99 |
| 2,807,805 | 10/1957 | Allan | 450/98 |
| 3,295,530 | 1/1967 | Mayer et al. | 450/104 |
| 3,909,847 | 10/1975 | Holt et al. | 2/2 |
| 4,894,867 | 1/1990 | Ceravolo et al. | 2/238 |
| 4,969,216 | 11/1990 | Guelli | 2/400 |
| 4,984,304 | 1/1991 | Brown | 2/400 |
| 5,103,505 | 4/1992 | Llorens | 2/403 |
| 5,157,789 | 10/1992 | Klass | 2/114 |

*Primary Examiner*—Gloria M. Hale

*Attorney, Agent, or Firm*—Galgano & Burke

[57] ABSTRACT

A padded brief especially for men comprising a garment shell having a front side and a rear side and at least one pad removably mountable on the rear side of the padded brief.

3 Claims, 2 Drawing Sheets

MEN'S PADDED BRIEF

This is a continuation of application Ser. No. 08/493,921 filed on Jun. 23, 1995 and now abandoned.

BACKGROUND OF THE INVENTION

1. Field of the Invention

The present invention relates to padded briefs for various apparel such as undergarments, trousers, and the like. More particularly, the present invention relates a new improved padded brief for men having removable pads.

2. Description of the Prior Art

Innovations for padded clothing apparel have a long history of use in the clothing industry and have enjoyed considerable success. For example, the padded brassiere for women has been in use in the United States and throughout the world for several decades and padded shoulder inserts, while generally newer in the art, have also enjoyed success.

Placing pads and the like into various clothing apparel can offer several advantages over non-padded apparel; added protection, enhanced shape, and added comfort and support. For example, a padded brassiere can enhance a woman's breast appearance or size by, depending on the exact positioning of the pad, providing additional undersupport for the breast thereby creating the illusion of larger breasts or, if the pads are positioned entirely over the breasts, by filling the wanting areas of the bra itself thereby creating the same illusion.

Although the "cod piece" has been around since the early 1600's, recently, several innovations for men's apparel have found their way into the padded apparel art. For example, one innovation provides an extra pad sewn into the front portion of a man's brief creating the illusion of a larger penile member. Other recent innovations include pads sewn into the rearward portion of a man's brief thereby creating the illusion of a fuller rearend (gluteus maximus) and/or providing support and protection for the same.

The main disadvantage to the above-mentioned male clothing products is that the pad or pads are permanently sewn or secured to the brief. Furthermore, the prior art devices don't allow for adjustability depending upon an individual's particular preference; various shaped and/or sized padding cannot be removed and/or inserted into the brief when desired.

While apparently generally acceptable for their intended functions, so far as is known, none of the prior art devices afford an improvement in padded briefs or undergarments comprising a garment shell having a frontal side and a rearward side and at least one pad removably attached and/or insertable at the rearward side of the padded brief and a means for removably attaching and/or inserting at least one pad at the rearward side of the padded brief.

In particular, and by and large, the prior art devices offer no adjustability or flexibility in use.

SUMMARY OF THE INVENTION

Accordingly, it is an object of the present invention to provide an improvement on a men's padded brief or underpants having at least one pad removably positioned at the rearward side of the padded brief to enhance and/or enlarge the appearance of the wearer's rear end.

It is another object of the present invention to provide such a men's padded brief which is economical to manufacture, adjustable, flexible, yet durable, and relatively of simple construction and design.

Another object of the invention is to provide a padded brief which can be worn and easily adjusted in a delicate and safe and comfortable manner.

Still another object of the present invention to provide a padded brief in which the padding comes in several different shapes and sizes and is interchangeable depending upon an individual's particular preference.

Yet still, it is another object of the present invention to provide a men's padded brief having a resilient pad which can be inserted and secured in a relatively simple and quick manner.

Certain of the foregoing and related objects are attained in accordance with the present invention by the provision of an improved men's padded brief for various apparel such as underpants, boxer shorts, trousers, and the like. The improved padded brief comprising a garment shell having a front side and a rear side, the rear side having at least one pad removably mountable thereto and means for removably mounting the pad onto the rear side of the brief, whereby it will be positioned generally opposite to the rear end of the wearer thereby enlarging the appearance thereof Preferably, the pad is removably mounted on the inner face of the rear side of the garment shell. Advantageously, the means for removably mounting the pad to the garment shell includes at least one garment panel secured to the inner face of the rear side forming at least one side pocket or sleeve in which the pad is removably insertable. Most desirably, the garment panel defines two pockets wherein two pads are provided each of which is insertable within an opposite one of the pockets. In some instances, however, it may be desirable to have several pockets and/or several differently shaped pads secured at different locations along the inner face of the rear side.

In a particular preferred embodiment of the present invention, the pockets and side panels are of semicircular shape. However, in some instances it may be desirable to have circular, oval, rectangular, or oddly shaped pockets, or, it may be desirable to have custom formed pockets for a particular user.

In the preferred embodiment, the panel is sewn onto the inner face of the garment shell, but it may be desirable to have the panel secured by Velcro, adhesive, snap-fit and/or other fastening means.

BRIEF DESCRIPTION OF THE DRAWINGS

Other objects and features of the present invention will become apparent from the following detailed description considered in connection with the accompanied drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
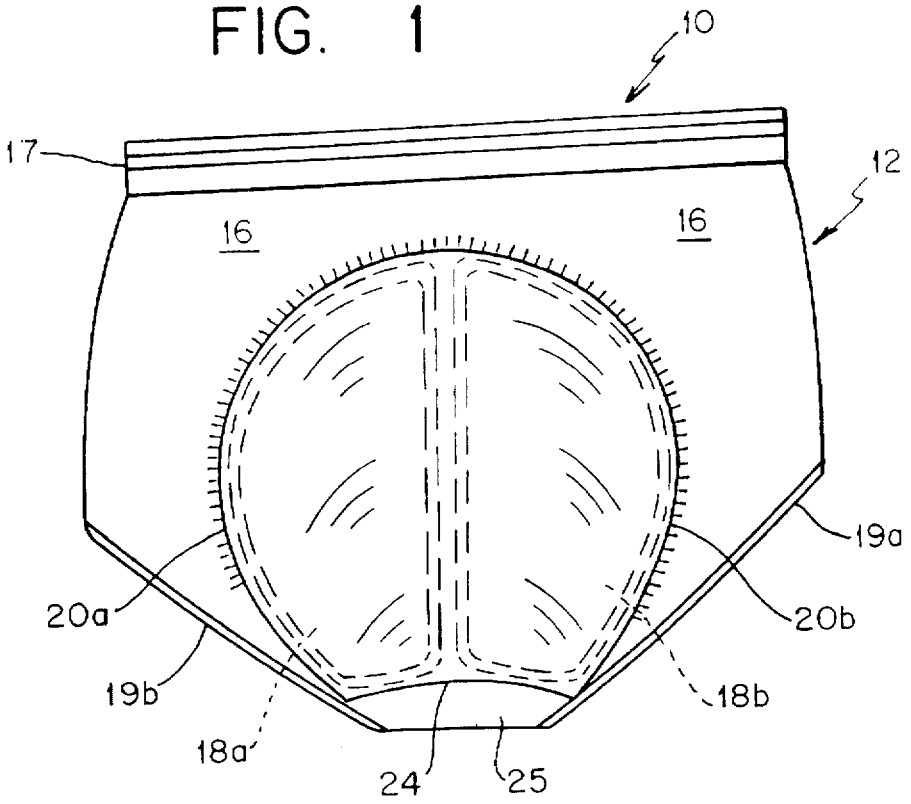
FIG. 1 is a rear elevational view of a men's padded brief embodying the present invention having a garment shell with two pads removably positioned therein.
Figure 2:
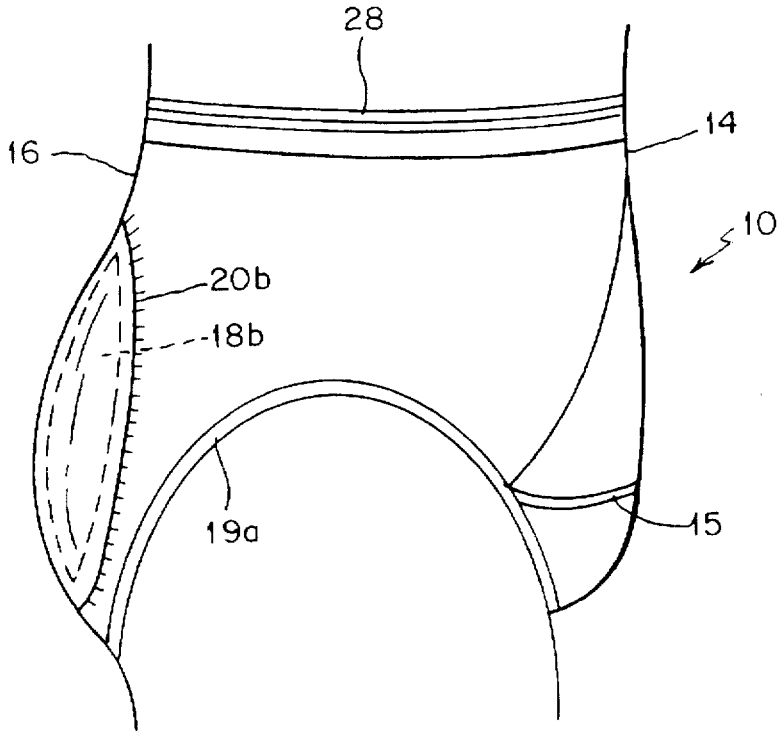
FIG. 2 is a side elevational view of the padded brief shown in FIG. 1.

Turning now in detail to the appended drawings, and in particular FIGS. 1 and 2, therein illustrated is an improved men's padded brief embodying the present invention generally designated by reference numeral 10. Brief 10 includes a garment shell 12 having a front side 14 and rear side 16, an upper circumferential elastic waistband 17 defining an upper opening and two leg openings 19*a* and 19*b*. The front side 14 of brief 10 is provided with a convenient slotted front opening 15 and the rear side 16 has pockets 20*a* and 20*b* formed on the inside or front face 16*a* thereof in which pads 18*a* and 18*b* are removably inserted, respectively.

FIG. 2 shows brief 10 in use or as worn and highlighting pad 18*b* with a preferred contour shape which is removably contained within pocket 20*b*. Pads 18*a* and 18*b* can be designed in a variety of shapes and sizes to accommodate the needs and desires of a particular user to create the desired effect; i.e., a fuller rear end.

Figure 3:
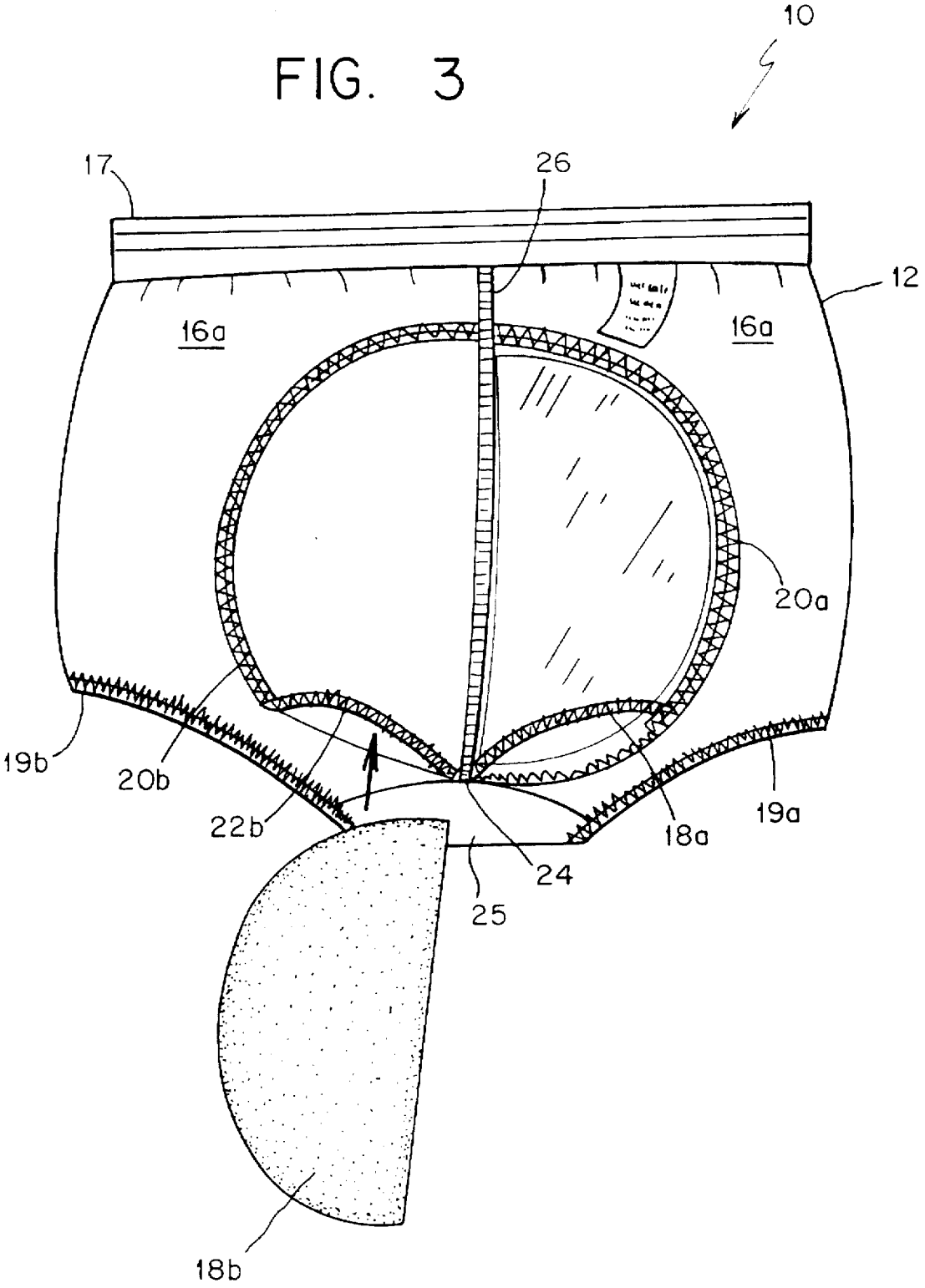
FIG. 3 is a front elevational view of the brief rear panel illustrating insertion of one of the removable pads into one of the pair of pockets provided on the inside front face of the rear panel.

Turning now to FIG. 3, the generally semicircular pockets 20*a* and 20*b* are sewn or stitched onto the inside face 16*a* of rearward side 16 with pocket openings 22*a* and 22*b* located adjacent to the rear end 24 of the crotch panel 25. Advantageously, pockets 20*a* and 20*b* are of generally semi-circular or arched shaped design and are preferably oppositely disposed on either side of mid-seam 26. Mid-seam 26 extends vertically from the rear end 24 of the crotch panel 25 to waistband 28. Desirably, pockets 20*a* and 20*b* have their respective base portions (diameters) positioned parallel to mid-seam 26 to create a more "natural" look. Pocket openings 22*a* and 22*b* generally of sufficient size and dimension to allow complimentary configured semi-circular foam pads 18*a* and 18*b* to be easily and facially inserted and removed therefrom while at the same time, providing sufficient retention to hold the same in proper position when the garment is worn; i.e., typically, the openings will be smaller than the greatest width of the resilient pads which can then be compressed to squeeze through the opening and then "re-expanded" to their normal size to completely fill the associated pocket. In a preferred embodiment, pocket openings 22*a* and 22*b* may be formed from elastic material to create the desired releasable retentive effect.

Various modifications may be made as will be apparent to those skilled in the art. For example, while the pads 18*a* and 18*b* are preferably made from sponge or foam rubber material, other resilient materials may be used as well such as soft plastic, feathers, cloth, leather and the like. In addition, pockets 20*a* and 20*b* although preferably made from the same cloth as garment shell 12, may be formed from a different material or provided with additional cushioning for comfort and/or added shape.

Moreover, pads 18*a* and 18*b* may be secured using alternate means for attachment such as Velcro, buttons, snaps and the like or other fastening systems. In addition, pads 18*a* and 18*b* may be of different shapes and/or sizes depending upon particular preference. In another embodiment, a single pad 18*a* or 18*b* might be designed to cover the entire desired portion to create a more natural look or a particular desired effect. Advantageously, pockets 20*a* and 20*b* are vertically disposed with each respective bottom opening, 22*a* and 22*b*, located substantially towards the bottom portion of the brief but other orientations (lateral, opening towards or at the top, or any combination thereof) may be desirable.

The invention is specifically designed for men's briefs but can be also be used with men's boxers, pants or trousers.

The pads 18*a* and 18*b* are preferably generally contour-shaped for their intended purpose; to create the illusion of a fuller rearend. Other embodiments can include a variety of different shapes and sizes depending upon particular preference and desirability.

Accordingly, while only one embodiment of the present invention has been illustrated in the appended drawings, it is to be understood that various modifications may be made as will be apparent to those skilled in the art.

What is claimed is:

1. An improved men's padded brief for use in enhancing the appearance of a wearer's rear end, said brief comprising:

a garment shell having a front side and a rear side which form an upper waistband opening and two lower leg openings separated by a lower crotch panel;

two semi-circular shaped removable pads mountable on said rear side of said garment shell so as to form a circular-shaped padding to cover the rear end of an intended wearer to thereby enlarge the appearance thereof; and means for releasably mounting said two semi-circular shaped removable pads on said rear side of said brief spaced from said upper waistband opening and said lower crotch panel so that said pads are positioned generally opposite to the rear end of an intended wearer to thereby enlarge the appearance thereof, said means comprising a garment panel partially secured to an inner face of said rear side of said garment shell, said garment shell and said garment panel having a mid-seam extending vertically from the crotch panel to the waistband opening to form two side-by-side semi-circular shaped pockets each having an opening in which each of said removable semi-circular shaped pads is insertable into an opposite one of said side-by-side semi-circular shaped pockets, said openings being disposed adjacent to said crotch panel, inside said garment shell, and said openings having a width which is smaller than the width of said removable semi-circular shaped pad and wherein said pad is resilient to allow the same to be compressed so as to enable it to be introduced into and removed from said opening in said side-by-side semi-circular shaped pocket.

2. The men's padded brief according to claim 1, wherein said panel is sewn onto said inner face.

3. The men's padded brief according to claim 1, wherein said pad is a foam pad.

* * * * *